US005181577A

United States Patent [19]

Tsukamoto et al.

[11] Patent Number: 5,181,577

[45] Date of Patent: Jan. 26, 1993

[54] DEVICE FOR FIXING DISK CUTTER TO TUNNEL EXCAVATOR

[75] Inventors: Toshio Tsukamoto; Yoshihito Minami, both of Hirakata, Japan

[73] Assignee: Kabushiki Kaisha Komatsu Seisakusho, Tokyo, Japan

[21] Appl. No.: 838,787

[22] PCT Filed: Sep. 19, 1990

[86] PCT No.: PCT/JP90/01199

§ 371 Date: Mar. 17, 1992

§ 102(e) Date: Mar. 17, 1992

[87] PCT Pub. No.: WO91/04393

PCT Pub. Date: Apr. 4, 1991

[30] Foreign Application Priority Data

Sep. 25, 1989 [JP] Japan ..... 1-110926[U]

[51] Int. Cl.[5] ..... E21B 10/10

[52] U.S. Cl. ..... 175/261; 175/263; 299/86

[58] Field of Search ..... 175/261, 262, 263, 264; 299/86

[56] References Cited

U.S. PATENT DOCUMENTS 3,787,101 1/1974 Sugden ..... 175/364 X
3,791,705 2/1974 Schimel ..... 175/363 X
4,784,438 11/1988 Fikse ..... 299/86

FOREIGN PATENT DOCUMENTS 58-189497 11/1983 Japan .
62-1068 1/1987 Japan .

*Primary Examiner*—David J. Bagnell
*Attorney, Agent, or Firm*—Flynn, Thiel, Boutell & Tanis

[57] ABSTRACT

A device for fixing a disk cutter to the cutter head of a shield excavator, wherein a plurality of cylindrical cases (2) are provided on the face plate (1*a*) of the cutter head (1) rotatably disposed on the front part of the shield proper, bosses (3) are disposed to project face-to-face in each of said cases (2), U-shaped grooves (4*a*) of retainers (4) provided on both ends of a shaft (7) rotatably supporting the cutter proper (5) are fitted on the bosses (3) so that the cutter proper (5) is turned around the shaft (7) together with the retainer (4); a key block (10) is fixed to the open side of the U-shaped groove (4*a*) formed on said retainer (4); and the proper (5) is fixed to the case (2) with the boss (3) clamped by the key block (10) and the retainer (4). In this way, the cutter proper can be fixed to the case without forming insertion grooves therein.

1 Claim, 4 Drawing Sheets

DEVICE FOR FIXING DISK CUTTER TO TUNNEL EXCAVATOR

TECHNICAL FIELD

The present invention relates to a device for fixing a disk cutter to the cutter head of a shield excavator for excavating a working face.

BACKGROUND TECHNOLOGY

A conventional shield excavator for excavating a tunnel has the cutter head which is disposed at the front portion of a shield body and rotatably driven by a cutter motor in which the cutter head has plural disk cutters which are rotatably provided at the front surface of the cutter head. When the cutter head is rotatably driven, these disk cutters excavate the working face.

The conventional disk cutter is, e. g. disclosed in Japanese Laid-Open Patent Publication No. 58-18497 in which a rotary cutter is fixed to a fixing seat in the steps of inserting a shaft supporter through an insertion groove defined on the fixing seat into a U-shaped notched portion of a rotary disk, inserting a spacer at the rear portion of the shaft supporter, turning a rotary portion 180°, attaching a presser member and fixing the presser member to the fixing seat by bolts.

In the conventional disk cutter, there was such a problem that the fixing portion has been large scaled since the height of the fixing seat should be increased in order to increase the strength of the fixing seat because of the insertion grooves in the fixing seat.

There was another problem that the structure is complex since many parts are necessitated for fixing the rotary cutter to the fixing seat and the rotary cutter drops when wheels are loosened by a load applied thereto in a rotary direction, thereby deteriorating its working efficiency or preventing the shied excavator from excavating further.

The present invention has been made to improve the problems of the conventional disk cutter and to provide a device for fixing the disk cutter to the shield excavator, which is simple in structure and reduced in the height in the fixing portion so as to be capable of fixing many disk cutters to the cutter head.

DISCLOSURE OF THE INVENTION

The present invention comprises a plurality of cylindrical cases provided on a face plate of a cutter head which is rotatably disposed on the front part of a shield proper, bosses disposed to project face-to-face in each of these cases, retainers having U-shaped grooves therein and provided at both ends of a shaft rotatably supporting a cutter proper, the U-shaped grooves being fitted onto the bosses, a key block fixed to the open side of the U-shaped groove which is formed on the retainer wherein the cutter proper can be fixed to the case with the boss clamped by the key block and the retainer.

Accordingly, the cutter proper can be fixed to the case without forming insertion grooves in the case for thereby reducing the height of the case, so that more pieces of cutters can be fixed to the cutter head, and it is possible to provide a fixing device having a simplified structure and capable of being mounted easily, reducing a load applied to a fixing bolt and being excellent in the strength thereof.

BRIEF DESCRIPTION OF THE DRAWINGS

The drawings show a device for fixing disk cutter to tunnel excavator according to an embodiment of the present invention in which.

BEST MODE FOR CARRYING OUT THE INVENTION

Figure 1:
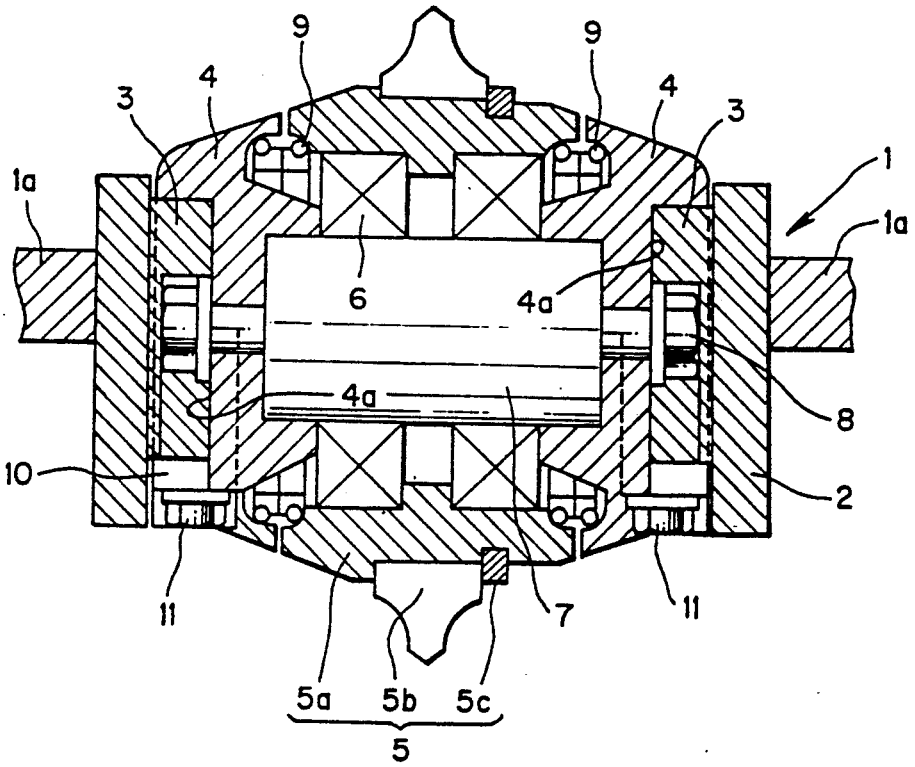
FIG. 1 is a cross-sectional view showing an assembled fixing device.
Figure 2:
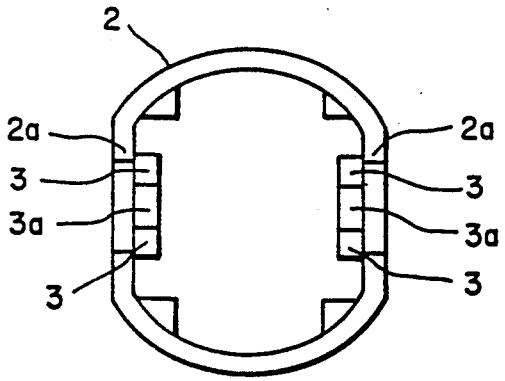
FIG. 2 is a front view of a case and FIGS. 3 to 8 are views showing steps of assembling a cutter proper.

An embodiment of the present invention will be described with reference to the drawings.

In the figures, denoted at 1 is a cutter head rotatably disposed on the front part of a shield proper (not shown) and a plurality of cases 2 are provided on a face plate la of the cutter head.

The case 2 is cylindrical and has flat portions 2*a* which are confronted to each other. Cylindrical bosses 3 protrude from the inner surfaces of the flat portions 2*a* and have U-shaped grooves 3*a* having openings at the cutter insertion side. U-shaped grooves 4*a* formed on a retainer 4 are fitted on the bosses 3.

A cutter proper 5 comprises a hub 5*a* and a cutter ring 5*b* fitted on a periphery of the hub 5*a* and the cutter ring 5*b* is retained by a split ring 5*c* not to come out from the hub 5*a*.

The hub 5*a* of the cutter proper 5 is rotatably supported by a shaft 7 by way of bearings 6 and the retainer 4 is attached to the both ends of the shaft 7 by way of a retainer bolt 8. Floating seals 9 are provided between the retainers 4 and both ends of the hub 5*a* of the cutter proper 5 for preventing earth and sand from entering the bearing 6 side.

A key block 10 has bolt insertion holes 10*a* bored at both ends thereof (refer to FIG. 6) through which bolts 11 are inserted and screwed into the retainers 4 at the tip ends thereof. Denoted at 12 is the earth.

An operation of the device for fixing a disk cutter to a shield excavator according to the embodiment will be described hereinafter.

Figure 3:
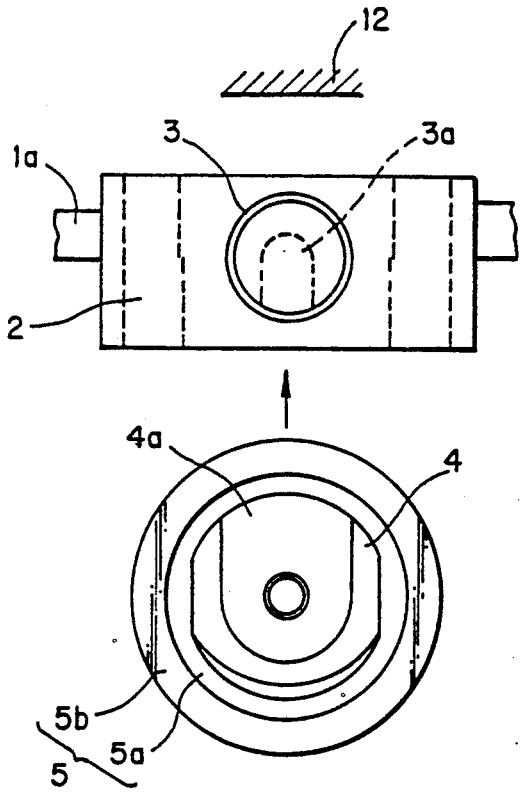
Figure 4:
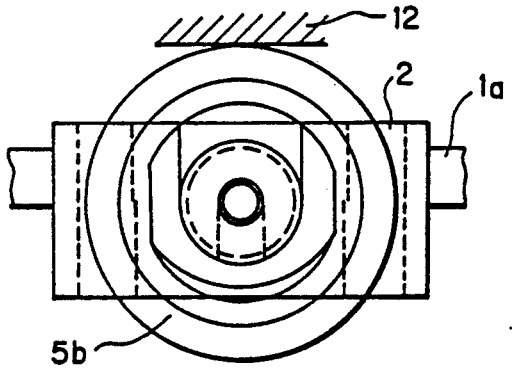

Before fixing the cutter proper 5 to the case 2, the opening of the U-shaped groove 4*a* of the retainer 4 is directed toward the case 2 as illustrated in FIG. 3. At this state, the cutter proper 5 is inserted into the case 2 as illustrated in FIG. 4 until the cutter ring 5*b* of the cutter proper 5 is brought into contact with the earth.

At this time, the bosses 3 protruding from the inner surface of the case 2 are fitted in the U-shaped grooves 4*a* of the retainer 4 and the heads of the retainer bolts 8 are fitted in the U-shaped grooves 3*a* of the bosses 3.

Figure 5:
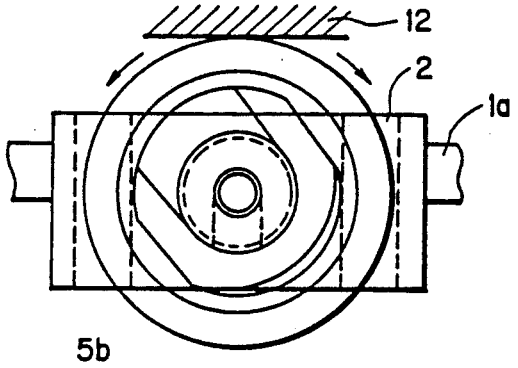
Figure 6:
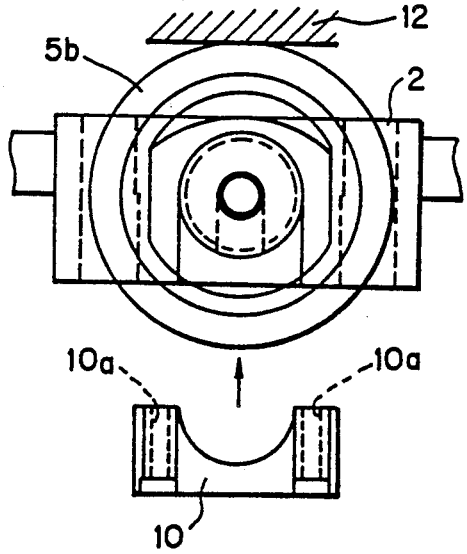
Figure 7:
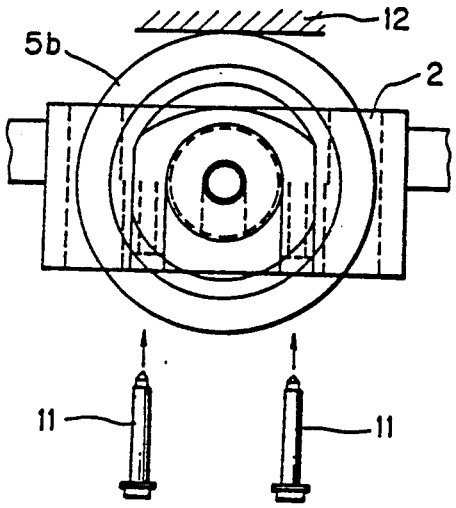
Figure 8:
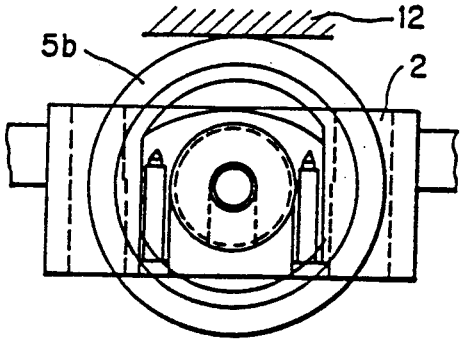

Thereafter, when the cutter proper 5 is turned 180° about the shaft 7 as illustrated in FIG. 5 to thereby direct the openings of the U-shaped grooves 4*a* of the retainers 4 toward the insertion side of the cutter proper 5. Successively, the key block 10 is fitted on the cutter proper 5 as shown in FIG. 6 and the bolts 11 are inserted into the bolt holes 11*a* of the key block 10 as shown in FIG. 7 in order to screw the tip ends of the bolts 11 into the retainer 4 whereby the key block 10 is fixed to the retainer 4 as shown in FIG. 8.

In this way, since the bosses 3 are clamped by the retainers 4 and the key block 10, the retainers 4 and the shaft 7 are fixed to the case 2 and the cutter proper 5 can be turned about the shaft 7.

According to the embodiment set forth above, one cutter ring 5*b* is fitted on the periphery of the hub 5*a* but plural cutter rings 5*b* can be fitted on the periphery of the hub 5*a*.

INDUSTRIAL UTILIZATION

In the present invention, as described in detail above, the U-shaped grooves of the retainer are fitted onto the bosses protruding from the inner surface of the case and the bosses are clamped by the retainers and the key block attached to the retainers to thereby fix the shaft supporting the cutter proper to the case by way of the retainers whereby the excavation reaction force applied to the cutter proper is received by the case by way of the key block, which results in reducing the load applied to the bolts which attach the key block to the retainer.

With such an arrangement, it is possible to solve such problems that the bolts are slackened or broken during the excavation so that the cutter proper drops out from the retainers. Furthermore, since the notched portion is not necessary to be provided on the case, the height of the case can be reduced whereby excavating capability can be remarkably improved since many disk cutters can be attached to the cutter head compared with the conventional device.

Still furthermore, the cutter ring can be replaced by a new cutter ring with ease since the replacement can be made without disassembling the retainers even if the cutter ring is worn away. Since the cutter proper is fixed to the case by turning the cutter proper about the shaft which supports the cutter proper, it is possible to attach the cutter proper to the case with ease.

We claim:

1. A device for fixing a disk cutter to a shield excavator comprising a plurality of cylindrical cases provided on a face plate of a cutter head which is rotatably disposed on the front part of a shield proper, bosses disposed to project face-to-face in each of these cases, retainers having U-shaped grooves therein and provided at both ends of a shaft rotatably supporting a cutter proper, the U-shaped grooves being fitted onto the bosses, a key block fixed to the open sides of the U-shaped grooves which are formed on the retainers wherein the cutter proper can be fixed to the case with the bosses clamped by the key block and the retainers.

* * * * *